United States Patent [19]

Rowbottam

[11] 4,044,548

[45] Aug. 30, 1977

[54] TIME INDICATING APPARATUS AND TRANSMISSION MECHANISM THEREFOR

[75] Inventor: Francis W. Rowbottam, Santa Barbara, Calif.

[73] Assignee: New England Business Service, Inc., Townsend, Mass.

[21] Appl. No.: 670,619

[22] Filed: Mar. 26, 1976

[51] Int. Cl.[2] ..... G04B 19/02; G06C 15/26

[52] U.S. Cl. ..... 58/125 C; 74/142; 235/134; 346/91

[58] Field of Search ..... 58/2, 125 C, 147; 74/126, 128, 142; 235/134; 346/82–86, 89, 91

[56] References Cited

U.S. PATENT DOCUMENTS

| | | | |
|---|---|---|---|
| 2,596,370 | 5/1975 | Bush | 235/134 |
| 3,830,053 | 8/1974 | Koide et al. | 58/125 C |
| 3,931,705 | 1/1976 | Iwaki et al. | 58/125 C |

FOREIGN PATENT DOCUMENTS

| | | | |
|---|---|---|---|
| 1,396,199 | 6/1975 | United Kingdom | 58/125 C |

*Primary Examiner*—Stanley J. Witkowski
*Attorney, Agent, or Firm*—Lindenberg, Freilich

[57] ABSTRACT

A time clock is provided which includes a minute wheel that is advanced every minute and an hour wheel that must be advanced every hour, wherein a deflecting pawl device is utilized, in place of gears, to connect the wheels. Both wheels have ratchet teeth, and a pawl that oscilltes once each minute to advance the minute wheel. The minute wheel, which rotates once every hour, has a cam that moves beside the pawl to deflect it sidewardly so that the pawl engages a tooth on the hour wheel. Thus, at the next oscillation of the pawl, both wheels are advanced. The minute wheel bears the numbers 0 through 59, while the hour wheel bears the numbers 1 through 12 repeated five times, so that both wheels have 60 numbers.

11 Claims, 6 Drawing Figures

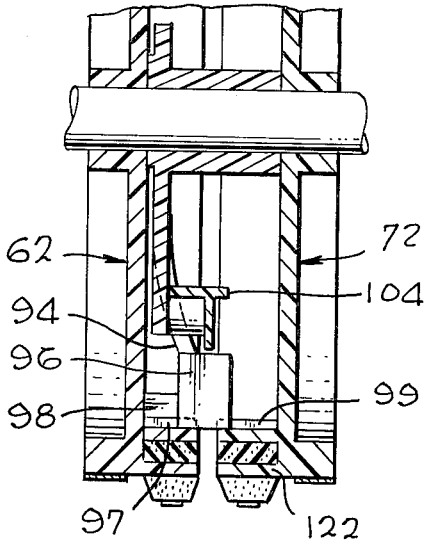
Fig. 5
Fig. 6
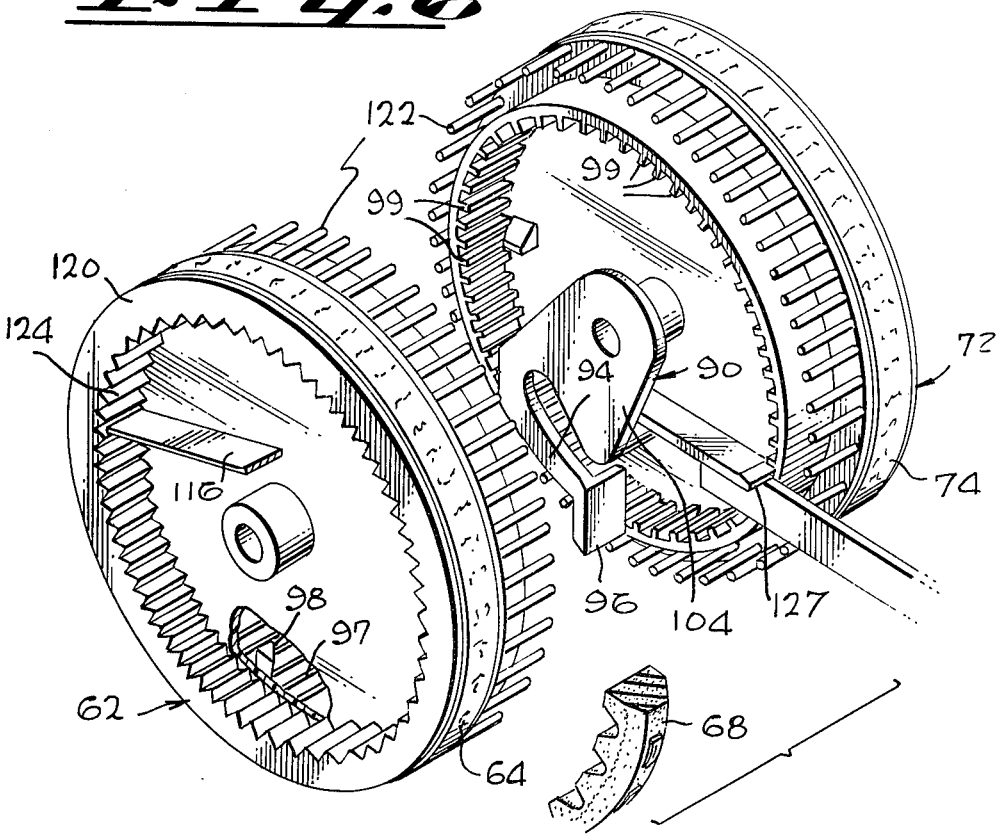

TIME INDICATING APPARATUS AND TRANSMISSION MECHANISM THEREFOR

BACKGROUND OF THE INVENTION

This invention relates to time indicating apparatus and to a transmission mechanism which is useful for transmitting intermittent motion in a variety of devices including time indicating apparatus.

Time indicating devices such as time clocks that stamp numbers on cards, normally utilize a minute wheel that is advanced once every minute, and an hour wheel that is advanced once every hour. A star wheel or other motion transmitting device is utilized to advance the hour wheel by a fraction of a turn after each completed rotation of the minute wheel. Such intermittent motion transmitting mechanisms typically have required the use of two or more additional gear-type wheels which must rotate on two or more different shafts, which adds to the expense of the machine. A simple intermittent motion transmission mechanism would enable the production at lower cost, of time indicating machines as well as other devices that require the transmission of intermittent motion.

SUMMARY OF THE INVENTION

In accordance with one embodiment of the present invention, a transmission mechanism is provided which enables the production of a low cost time clock. The time clock has a minute wheel which must be advanced once each minute, and an hour wheel which must be advanced once each hour. Each wheel is provided with ratchet teeth, and a pawl is provided that is oscillated once each minute and which is normally engaged with the teeth of the minute wheel to advance that wheel. A cam mounted on the minute wheel moves against the pawl at each revolution of the minute wheel, to deflect the pawl sidewardly so that it engages a ratchet tooth of the hour wheel as well as a tooth of the minute wheel. At the next oscillation of the pawl, it advances both the hour wheel and the minute wheel by one step.

In the time clock, the minute wheel has 60 numbers, 0 through 59 spaced along its periphery. The hour wheel also has 60 numbers, these being the numbers 1 through 12 repeated five times around the periphery of the hour wheel.

The novel features of the invention are set forth with particularity in the appended claims. The invention will be best understood from the following description when read in conjunction with the accompanying drawings.

BRIEF DESCRIPTION OF THE DRAWINGS

FIG. 5 is a view of a portion of FIG. 4, but showing the pawl thereof in a deflected orientation; and FIG. 6 is a partial exploded view of the time clock of FIG. 3.

DESCRIPTION OF THE PREFERRED EMBODIMENTS

Figure 1:
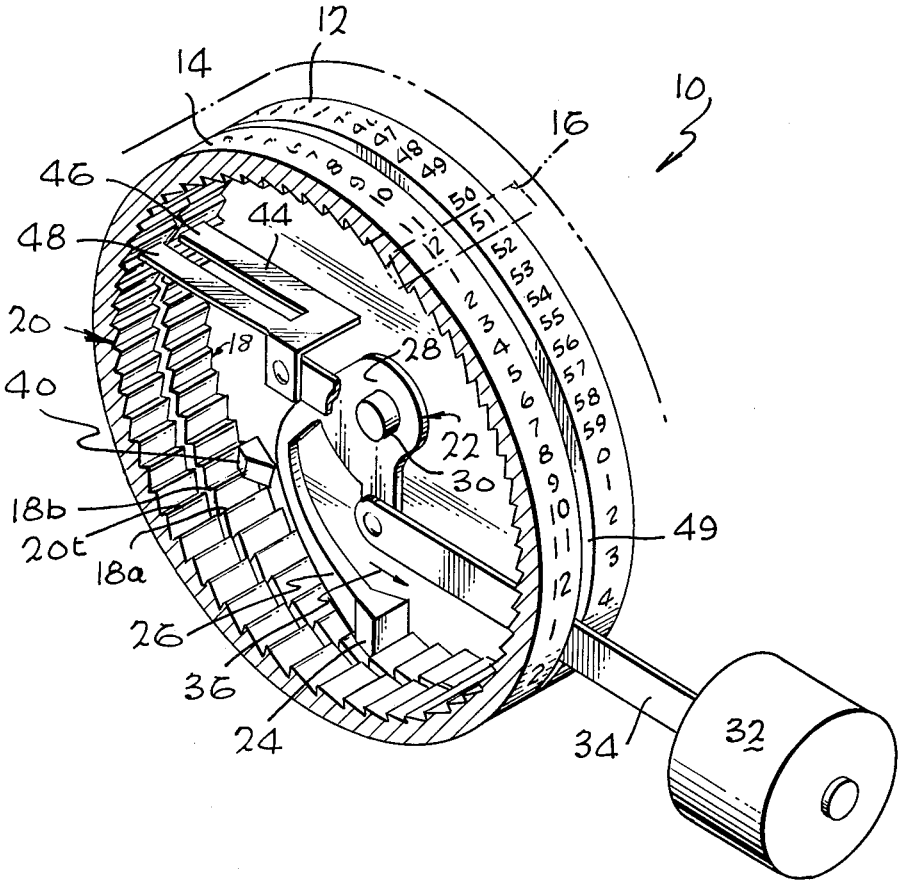
FIG. 1 is a simplified partial perspective view of a time indicating device, showing principals of operation of the invention.
Figure 2:
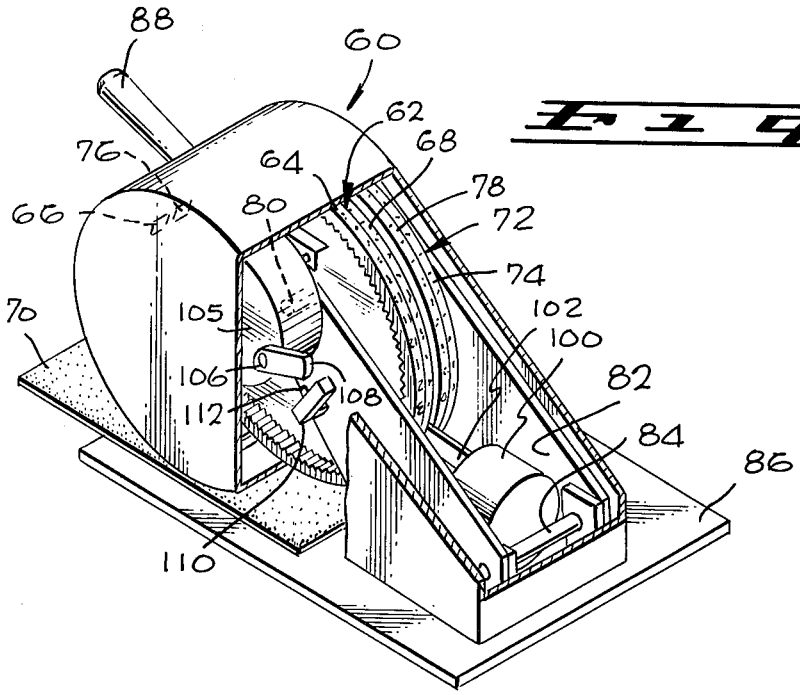
FIG. 2 is a partial perspective view of a time clock constructed in accordance with an embodiment of the present invention.

FIG. 1 is a simplified illustration of a timing device 10 which includes a minute wheel 12 and an hour wheel 14, for indicating the time through a window 16. The minute wheel 12 carries the numbers 0 through 59, and is advanced by one-sixtieth of a revolution (by 6° ) every minute, to display a next number. The hour wheel 14 carries the numbers one through 12 repeated five times, so that it contains 60 numbers. The hour wheel is advanced by one-sixtieth of a revolution after every hour.

Each of the wheels 12, 14 has a series of sixty ratchet teeth circumferentially spaced around the wheel, with the ratchet teeth 18 of the minute wheel lying close to the ratchet teeth 20 of the hour wheel. The mechanism for advancing the minute wheel includes a pawl device 22 with a pawl 24. The pawl 24 is held at the end of an arm 26 whose other end is mounted on a base 28 of the pawl device. The base 28 is freely rotatable on a shaft 30. The shaft 30 also supports hub portions of the minute and hour wheels 12, 14 to allow them to freely rotate on the shaft. The base 28 of the pawl device is reciprocated once every minute by a solenoid 32 which is coupled by a link 34 to the base of the pawl device. Every minute, the solenoid is activated to pivot the pawl device to that the pawl 24 moves in the direction of arrow 36 and then returns, to thereby advance the minute wheel by one pawl, and display a next number through the window 16.

A cam 40 serves to advance the hour wheel 14 once each hour. The cam 40 is fixed to the minute wheel 12 at a location adjacent to one of the ratchet teeth thereon, so that the cam moves along a path that extends beside the pawl 24 as the minute wheel turns. After the pawl 24 has engaged the rear of a ratchet tooth **18*a* and then draws back, the cam 40 deflects the pawl sidewardly, into engagement with a tooth 20*t* of the hour wheel. The pawl then lies in a position wherein it engages both the next minute tooth 18*b* and the hour tooth 20*t*. Accordingly, during the next forward movement of the pawl, in the direction of arrow 36, both the minute and hour wheels are advanced by one-sixtieth of a revolution. When the pawl next draws back, it rides beyond the cam 40**, and is released to engage only a tooth on the minute wheel.

Thus, the deflecting cam 40 which moves the deflectable pawl 24, provides a means for intermittently advancing the hour wheel 14 at a predetermined rotational position of the minute wheel. The mechanism performs this operation in a very simple manner which eliminates the need for intermediate gears that would have to rotate on separate shafts. In order to fix the positions of the wheels, a leaf spring 44 is provided which has two legs, 46, 48 that engage ratchet teeth of the two wheels. The solenoid link 34 is a thin member that fits through the small space 49 between the minute and hour wheels.

Figure 3:
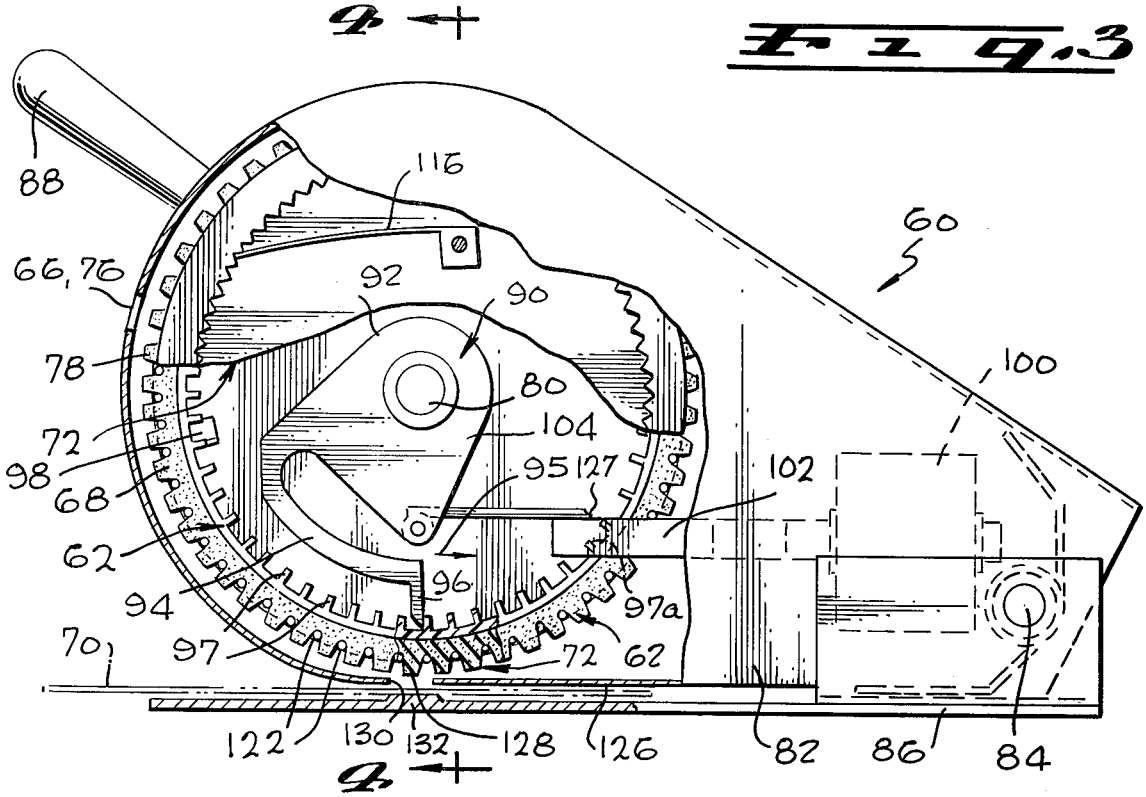
FIG. 3 is a partial sectional view of the time clock of FIG. 2.
Figure 4:
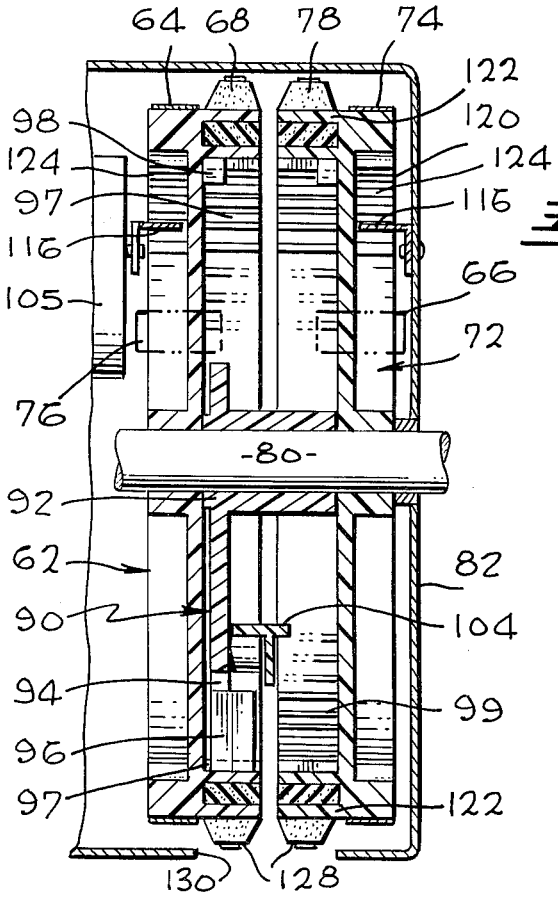
FIG. 4 is a partial sectional view taken on the line 4—4 of FIG. 3.

FIGS. 2 - 6 illustrate a time recorder 60 which utilizes the basic type of mechanism described above. The time recorder includes a minute wheel 62 with a visual band 64 for displaying numbers through a minute window 66, and a printing band 68 for printing the same numbers on a card 70 that is inserted into the machine. The recorder also includes an hour wheel 72 with an hour visual band 74 for displaying numbers through an hour window 76 and an hour print band 78 which stamps numbers on the card 70. Both wheels are rotatably mounted on a shaft 80 that is, in turn, mounted on a pivoting frame 82. The frame 82 can pivot on an axle 84 that is mounted on a base plate 86. Thus, when a person grasps a handle 88 on the frame and presses it down, the entire frame 82 and the hour and minute wheels thereon move down, so that the minute and hour print bands 68, 78 print numbers representing the time on the card 70, The mechanism for advancing the minute and hour wheels include (FIG. 4) a pawl device 90 with a base 92 freely rotatable on the shaft 80, a pawl support in the form of an arm 94, and a pawl 96 engaged with ratchet teeth 97 on the minute wheel. As also shown in FIG. 3, the arm 94 of the pawl device extends in a largely circumferential direction, which is parallel to its direction of oscillation, parallel to arrow 95, so that the pawl can apply forces to the ratchet teeth to advance the wheels, even though the pawl can bend to deflect up and down over the ratchet teeth and sidewardly to engage a tooth 99 on the hour wheel. A cam 98 (FIG. 6) on the minute wheel 62 serves to deflect the pawl sidewardly each rotation of the minute wheel, so that the pawl next engages a tooth 99 on the hour wheel to also advance the hour wheel. FIG. 5 shows the pawl 96 deflected so it engages a tooth 97, 99 on each wheel.

The pawl device (FIG. 3) is reciprocated by a solenoid 100 which is coupled through a link 102 to an arm 104 of the pawl device, the link 102 being pivotally connected at its opposite ends to the pawl device and to the solenoid. The solenoid is energized once every minute by a synchronous motor 105 (FIG. 2) which is connected through wires (not shown) to an ordinary alternating current outlet. The output shaft 106 of the motor rotates at one revolution per minute, and carries an activator 108. A switch 110 is mounted with its switch button 112 in the path of the activator 108, so that the switch 110 is closed once every minute. The switch current through the solenoid 100 to energize it once every minute. The link 102 extends through a space between the minute and hour wheels.

Each wheel, such as the minute wheel 62 (FIG. 6) includes a plastic molded wheel frame 120 which includes a series of pin-like retainers 122 along one side of its circumference. Each wheel also includes a porous rubber print band 68 or 78 held by the pin-like retainers, and a paper-like visual band 64 or 74 held by adhesive. The minute print band 68 has the numbers 0 through 59 formed as raised characters thereon, and hold ink which it can use to print numbers on a card. The hour wheel 72 is similarly formed, but with its print and visible bands defining the numbers 1 through 12 repeated five times.

The wheel frame 120 of the minute wheel 62 is identical to the wheel frame of the hour wheel. This reduces the cost of production, and especially the cost of making injection molds for the molding of plastic wheel frames. As a result of the use of minute and hour wheel frames formed from the same mold, the teeth such as 97 are formed symmetrical on their front and rearward sides. A set of anti-backup teeth 124 are formed on each wheel frame on a face thereof opposite the pawl-engaging teeth 97 or 99. A pair of anti-backup spring members 116 (FIG. 4) are mounted on the frame 82 of the time recorder, and have ends engaged with the anti-backup teeth 124.

In order to assure that each wheel is advanced by only 6° (one-sixtieth turn) at every forward stroke of the pawl, the link 102 is provided with a stop 127 that can engage the teeth 97, 99 on the wheels during movement of the link in the direction of arrow 95. With the mechanism as shown in FIG. 3, the next movement of link 102 in the direction of arrow 95 will cause advancement of the wheel, until stop 127 engages a tooth 97*a*.

When a person wishes to record the time on a card, he slips the card under a leaf spring guide 126 (FIG. 3) which lies under the frame 82. He then presses down on the handle 88 so that the minute and hour wheels move down with the frame. As the wheels move down, one portion 128 of each print band, representing one number on each corresponding band, can pass through an opening 130 in the spring 126 and press against a portion of the card which is supported on a raised area 132 of the base plate 86. Of course, a person can note the time by looking through the windows 66, 76. The numbers on the visual band and print band of each wheel are offset approximately 120° from one another, so that the same number that is printed by the print band is the number which is displayed through the corresponding window.

Thus, the invention provides a transmission mechanism for transmitting intermittent motion between a pair of rotatable wheels, and provides a timing device utilizing such a mechanism to enable simple and low cost construction. The transmission mechanism includes a means for advancing one of the wheels, which includes a movable device, such as a pawl, that is normally engaged with the first wheel but which is deflectable to also engage the second wheel. The mechanism also includes a deflecting cam means, such as a cam mounted on the first wheel, for deflecting the pawl or other advancing device into engagement with the second wheel while remaining engaged with the first wheel. This results in the second wheel being advanced at a particular rotational position of the first wheel. Of course, the same deflecting pawl-type mechanism could be employed to advance members other than wheels, such as linearly sliding racks, but is especially useful for devices which require intermittently movable wheels. In a timing device such as the time recorder described above, simplification is obtained by the use of only two rotating wheels, even though one displays 60 numbers while the other displays only 12 numbers. This is accomplished by repeating the numbers on the hour wheel five times so that there are the same number of steps on both wheels.

Although particular embodiments of the invention have been described and illustrated herein, it is recognized that modifications and variations may readily occur to those skilled in the art and consequently it is intended that the claims be interpreted to cover such modifications and equivalents

What is claimed is:

1. A timing device comprising:

a minute wheel having 60 numbers 0 through 59 formed thereon;

an hour wheel having a portion forming the numbers 1 through 12 repeated five times so that there are 60 numbers thereon; and means for rotating said wheels about a predetermined axis, said means rotating said minute wheel by one-sixtieth turn every minute, and rotating said hour wheel by one-sixtieth turn after each complete rotation of said minute wheel.

2. The timing device described in claim 1 wherein:

each of said wheels has 60 ratchet teeth thereon;

said means for rotating includes a pawl and means for oscillating said pawl against the ratchet teeth on said minute wheel; and said rotating means includes a cam mounted on said minute wheel and positioned to deflect said pawl into engagement with a ratchet tooth on said hour wheel.

3. Wheel driving apparatus comprising:

first and second rotatable wheels, means for advancing said first and second wheels, including a movable advancing device normally engaged with said first wheel, said advancing device being deflectable to also engage and supply-force in the direction of rotation of said second wheel to advance it; and deflecting cam means mounted on said first wheel to move with it, for deflecting said advancing device into engagement with said second wheel while remaining engaged with said first wheel, at a predetermined rotational position of said first wheel, whereby to intermittently advance the second wheel as a predetermined ratio of advancement of the first wheel.

4. The apparatus described in claim 3 wherein:

said first wheel contains means forming the numbers 0 through 59, and said second wheel contains means forming the numbers one through twelve repeated five times.

5. Wheel driving apparatus comprising:

first and second rotatable wheels, each having a series of ratchet teeth;

a pawl device having a base, a pawl, and an arm coupling said base to said pawl and normally holding said pawl adjacent to the ratchets on said first wheel, said arm extending in a primarily circumferential direction and being resiliantly sidewardly deflectable;

means for reciprocating said pawl device to oscillate said pawl in circumferential directions over the ratchet teeth of said first wheel; and deflecting cam means mounted on said first wheel to move with it, for deflecting said pawl device so that said pawl moves into engagement with said second wheel while remaining engaged with said first wheel, at a predetermined rotational position of said first wheel.

6. The apparatus described in claim 5 including:

a shaft; and wherein said first and second wheels are freely rotatable on said shaft; and said base of said pawl device is rotatably mounted on said shaft at a location between said wheels.

7. Wheel driving apparatus comprising:

first and second rotatable wheels, each having a series of ratchet teeth;

means for advancing said first wheel, including a pawl device having a base, a pawl, and an arm coupling said base to said pawl and normally holding said pawl adjacent to the ratchets on said first wheel, said advancing means also including a link having one end pivotally coupled to said base of said pawl device and means for reciprocating said link, thereby to oscillate said pawl over the ratchet teeth of said first wheel; and deflecting cam means mounted on said first wheel to move with it, for deflecting said pawl device into engagement with said second wheel while remaining engaged with said first wheel, at a predetermined rotational position of said first wheel;

said link having a stop (127) which engages a tooth on said first wheel at the end of each movement of said link in a predetermined forward direction during which said pawl advances said first wheel, whereby to limit the forward movement of said first wheel during each advancement thereof.

8. A timing device comprising:

a minute wheel and an hour wheel, both rotatably mounted about the same axis, and each having a series of ratchet teeth spaced thereabout;

a pawl device including a pawl and a deflectable support for said pawl;

means for reciprocating said pawl device so that said pawl thereof normally moves over the ratchet teeth of said minute wheel to advance it; and a cam mounted on said minute wheel so it moves beside said pawl during each rotation of said minute wheel, said cam being positioned to deflect said pawl into engagement with a ratchet tooth of said hour wheel, while said pawl also engages a tooth of the minute wheel, whereby to engage and advance said hour wheel during each turn of the minute wheel.

9. The timing device described in claim 8 wherein:

said minute wheel has means forming the numbers 0 through 59, and said hour wheel has means forming the numbers 1 through 12 repeated five times about the wheel.

10. The timing device described in claim 8 including:

a shaft, both of said wheels being freely rotatable about said shaft, and said pawl support comprises a base and a deflectable arm connecting said base to said pawl, said base being freely rotatable on said shaft at a location between said wheels; and said reciprocating means includes a thin link extending between said wheels and coupled to said pawl device, and means for reciprocating said link.

11. The timing device described in claim 8 wherein:

said reciprocating means includes a link coupled to said pawl device and means for reciprocating said link; and said link has a stop (127) which engages a tooth on said minute wheel at the end of each movement of said link in a predetermined forward direction during which said pawl advances said minute wheel, whereby to limit the forward movement of said minute wheel during each advancement thereof.

* * * * *